United States Patent [19]

Notkin

[11] Patent Number: 4,717,076

[45] Date of Patent: Jan. 5, 1988

[54] SPRINKLER DEVICE

[75] Inventor: Yosef Notkin, Kibbutz Gvat, Israel

[73] Assignee: Plastro Gvat, Kibbutz Gvat, Israel

[21] Appl. No.: 893,258

[22] Filed: Aug. 5, 1986

[30] Foreign Application Priority Data

Aug. 9, 1985 [IL] Israel ..... 76052

[51] Int. Cl.[4] ..... B05B 1/34

[52] U.S. Cl. ..... 239/467; 239/468

[58] Field of Search ..... 239/468–471, 239/467, 466, 463, 461, 489, 490, 498, 499, 518, 589, 601, 568, 276, 285

[56] References Cited

U.S. PATENT DOCUMENTS

| | | | |
|---|---|---|---|
| 580,151 | 4/1897 | Barnard . | |
| 1,731,555 | 10/1929 | Williams | 239/285 X |
| 2,247,897 | 7/1941 | Wahlin | 239/468 |
| 2,914,257 | 11/1959 | Wiant | 239/568 X |
| 3,347,471 | 10/1967 | Halls | 239/490 X |
| 4,087,050 | 5/1978 | Tsuji et al. | 239/490 |
| 4,092,003 | 5/1978 | Ikeuchi . | |

FOREIGN PATENT DOCUMENTS

| | | | |
|---|---|---|---|
| 176391 | 3/1953 | Australia | 239/468 |
| 23711 | 2/1977 | Japan | 239/463 |
| 2135215 | 8/1984 | United Kingdom . | |
| 501250 | 1/1976 | U.S.S.R. | 239/468 |

*Primary Examiner*—Andres Kashnikow
*Assistant Examiner*—Karen B. Merritt
*Attorney, Agent, or Firm*—Sandler & Greenblum

[57] ABSTRACT

A vortex sprinkler having a vortex chamber delimited in the downward direction by a bottom surface and in the upward direction by a rimmed opening leading to the atmosphere, at least one liquid inlet leading substantially tangentially into the vortex chamber, and a plurality of slots cut across the rim of the opening, wherein the slots are cut in a direction substantially tangential with respect to the vortex chamber.

11 Claims, 9 Drawing Figures

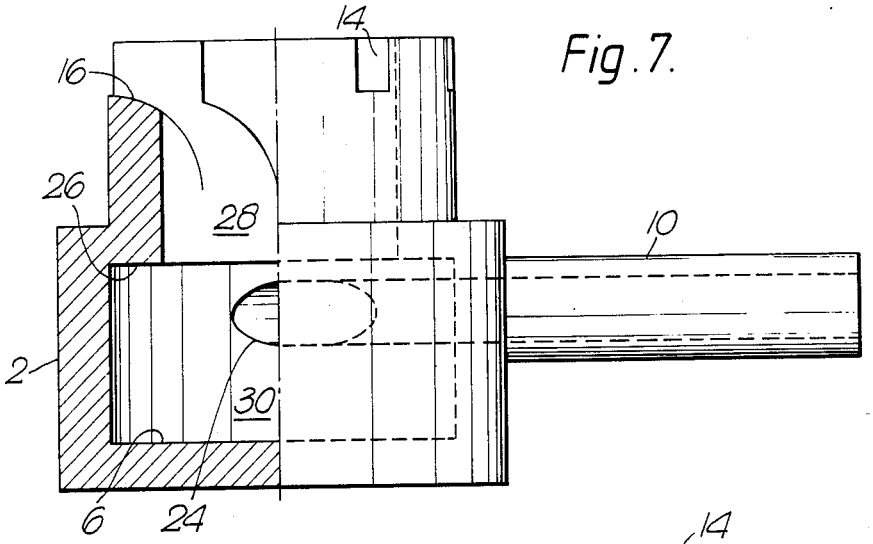
Fig. 7.
Fig. 8.
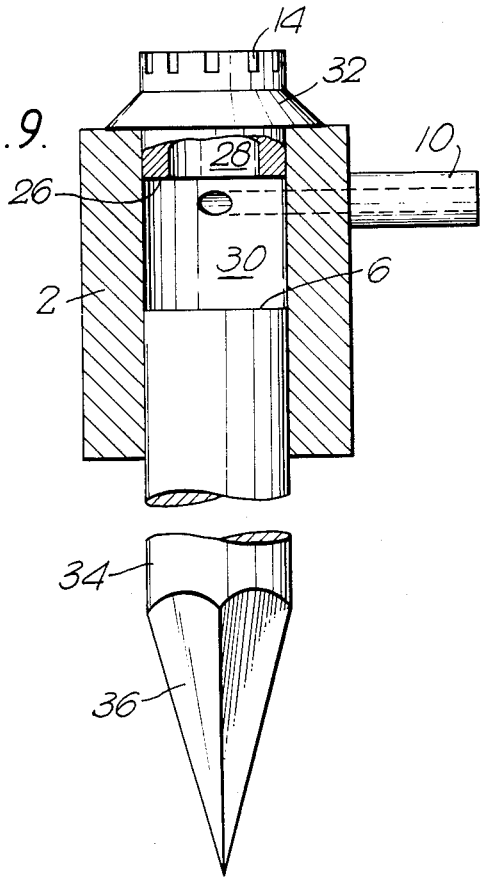
Fig. 9.

SPRINKLER DEVICE

The present invention relates to a water sprinklr, that is, a sprinkler in which the liquid, prior to leaving the device, is imparted an angular momentum which is supposed to improve the performance of the sprinkler with respect to its main parameters which are throw, pattern and uniformity of coverage, and droplet-size distribution, as well as the constancy and reproducibility of these parameters. Of particular importance is droplet-size distribution, because droplets below a certain size are liable to evaporate before they reach the ground or to drift off with the wind. A preponderance of oversize droplets, on the other hand, will impair throw and the sprinkling pattern. It is primarily on this point that existing vortex sprinklers tend to fail, causing waste, reducing irrigation efficiency and increasing irrigation costs.

It is one of the objects of the present invention to overcome the drawbacks of prior art vortex sprinklers, and to provide a sprinkler that produces a satisfactory throw and spray pattern, and is characterized by a droplet-size distribution that facilitates optimal use of irrigation water, thus reducing costs and increasing yields, while being of a design distinguished by great simplicity.

This the invention achieves by providing a vortex sprinkler comprising:

- a vortex chamber delimited in the downward direction by a bottom surface and in the upward direction by a rimmed opening leading to the atmosphere;
- at least one liquid inlet leading substantially tangentially into said vortex chamber, and
- a plurality of slots cut across the rim of said opening, wherein said slots are cut in a direction substantially tangential with respect to said vortex chamber.

This invention further provides a vortex sprinkler comprising:

- a vortex chamber delimited in the downward direction by a bottom surface and in the upward direction by a rimmed opening leading to the atmosphere;
- at least one liquid inlet leading substantially tangentially into said vortex chamber, and
- a plurality of slots cut across the rim of said opening, wherein at least a portion of the wall of said vortex chamber is upwardly and outwardly flaring, and wherein said slots are cut in a direction substantially tangential with respect to an imaginary circle constituting the intersection between the plane containing the bottom surfaces of at least some of said slots, and said flaring portion of said vortex chamber.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 7 is a front view, in partial cross section, along plane VII–VII of FIG. 5, of yet another embodiment of the sprinkler according to the invention;

FIG. 8 is a partial view, in perspective, of the embodiment of FIG. 7 and FIG. 9 is a front view, in partial cross section, of still another embodiment of the sprinkler according to the invention.

Figure 1:
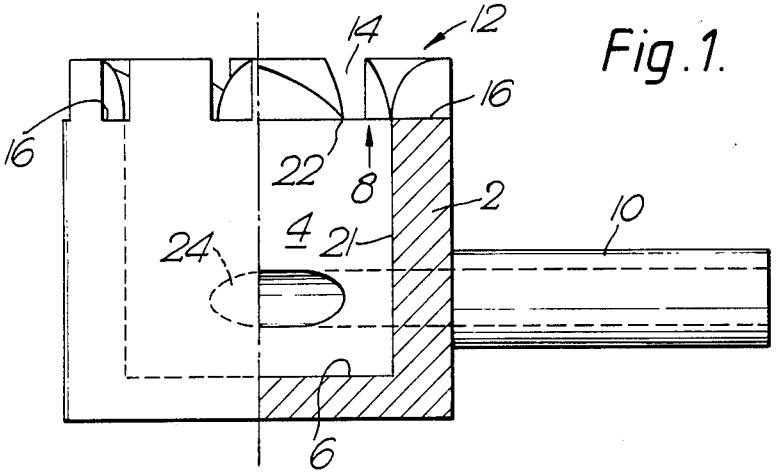
FIG. 1 is a front view, in partial cross section along plane I—I of FIG. 2, of a first embodiment of the sprinkler according to the invention.
Figure 2:
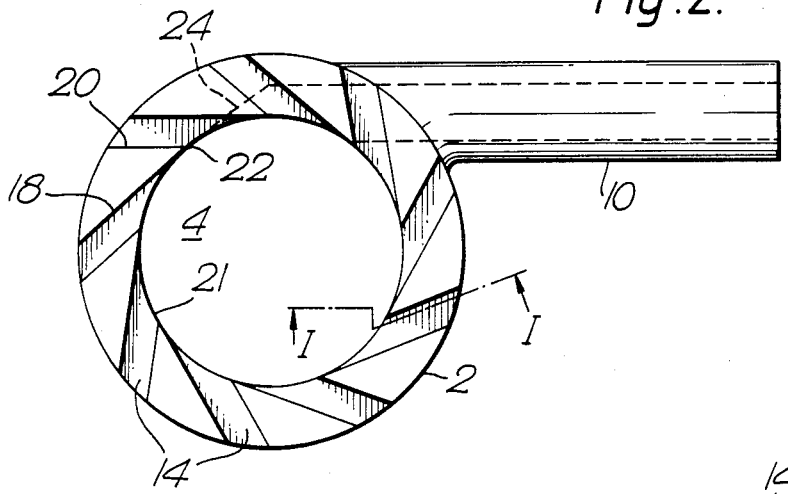
FIG. 2 is a top view of the sprinkler of FIG. 1.
Figure 3:
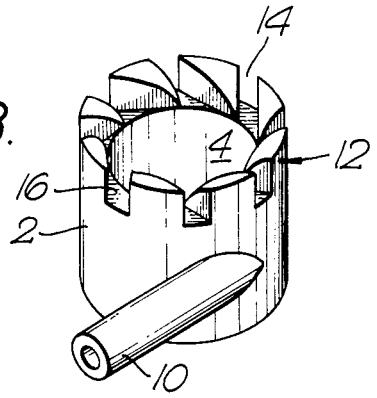
FIG. 3 is a perspective view of the embodiment of FIGS. 1 and 2.

Referring now to the drawings, there is seen in FIGS. 1, 2 and 3 a sprinkler body 2 in which is provided a cylindrical vortex chamber 4 delimited in the downward direction by a bottom surface 6 and in the upward direction by a rimmed opening 8. There is further seen a liquid inlet tube 10 which, in a substantially tangential direction, leads into the vortex chamber 4. Across the rim 12 of the opening 8 there are cut a plurality of slots 14 in a direction substantially tangential with respect to the vortex chamber 4, as is clearly seen in FIG. 2. The slots 14 are of identical depth and their bottom surfaces 16 are disposed in a common, radial plane. The width of the slots 14 is advantageously such that the longer slot wall 18 (see FIG. 2) and the shorter slot wall 20 of the adjacent slot meet at the vortex chamber wall surface 21, forming a point 22. It is, however, possible for a portion of "land" to remain between the end portion of the walls 18 and 20.

It is also seen that, from a point close to the intersection of the above plane with the wall surface 21 of the vortex chamber 4, the wall surface 21 begins to flare outwards, towards the outer end of the rim 12. In this embodiment, the curve defining the cross section of this flared portion is approximately a quadrant, but could also be part of one of the conical sections, or even a straight line, in which case the flaring portion would be chamfer like.

The sense of tangentiality of the slots obviously follows the sense of spin imparted to the liquid by the tangential inlet tube 10 of which, in the present embodiment, strictly speaking only the center line is truly tangential. To smoothly guide into the chamber 4 also that portion of the liquid which is "transtangential", an appropriate guide surface 24 is provided at the end of the bore of tube 10.

Without the tangential slots 14, the swirling liquid would largely be atomized into a fine mist, making the device worthless as an irrigation sprinkler because of the already mentioned drift and evaporation losses. As it is, the slots 14 cause the liquid to break up and coagulate into a spectrum of droplets large enough to keep evaporation to a minimum, while their tangentially enhances throw, as it does not break the angular momentum of the swirling liquid particles.

Figure 4:
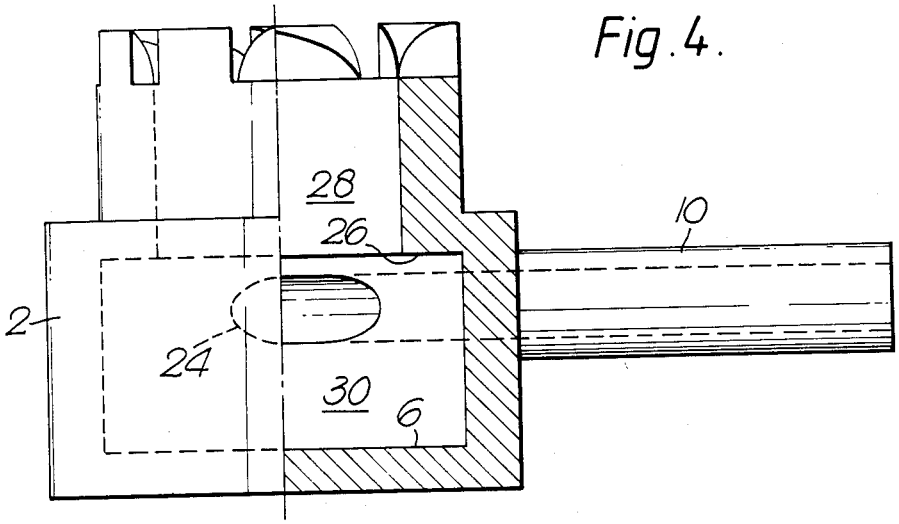
FIG. 4 shows a front view, in partial cross section along plane IV–IV of FIG. 5, of another embodiment of the sprinkler according to the invention.
Figure 5:
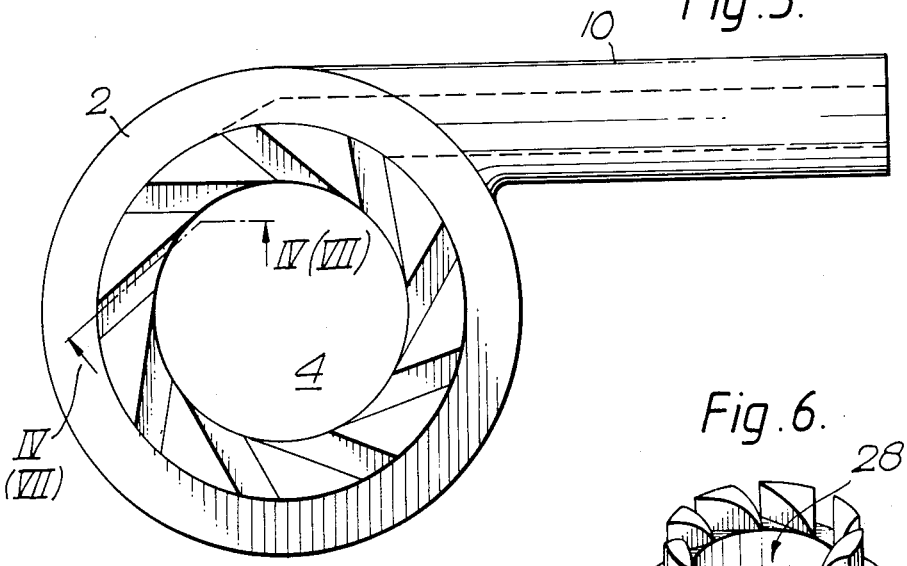
FIG. 5 is a top view of the sprinkler of FIG. 4.
Figure 6:
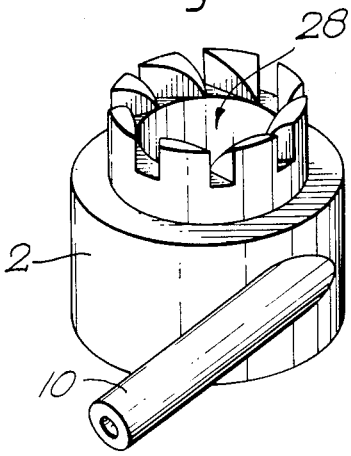
FIG. 6 is a perspective view of the embodiment of FIGS. 4 and 5.

Even better performances are obtained with the embodiment shown in FIGS. 4, 5 and 6, which is similar to the previous embodiment except for an important detail: the provision of a two-chamber vortex chamber produced by a shoulder-like transition portion 26 which divides the vortex chamber 4 into an upper chamber 28 contiguous with the opening 8 and having a smaller diameter, and a lower chamber 30 contiguous with the bottom surface 6 and having a larger diameter. The inlet tube 10, as can be seen, leads into the lower chamber 30. The transition portion 26, which in this embodiment is seen to be a simple square shoulder, can also take other forms, such as a chamfer, or a fillet, or the edge of its smaller diameter can be rounded off, and its surface may be smooth or serrated.

Great importance attaches to the width of the portion 26, i.e., to the difference of the diameters of chambers 28 and 30. The larger this difference, the more rapid the swirling motion in the upper chamber 28. It was found that at a certain $\Delta\phi$, the sprinkler becomes self-regulating, i.e., its output remains substantially steady over a considerable range of pressure fluctuations.

Another parameter seen to have an effect on the performance of sprinklers of the double-chamber type is the distance between the transition portion 26 and the bottom surface 6. A change in this distance will effect sprinkler output, as will the provision of more than one tangential inlet. As will be seen further below, the invention also provides an embodiment in which this distance can be varied.

The spray pattern of the embodiments shown so far is a uniform, mushroom-like fan, covering the ground in a substantially circular patch, the center of which is the sprinkler.

A further embodiment, to be explained presently, produces a plurality of distinct jets, equal in number to the number of tangential slots 14. Each of these individual jets slightly spreads on the way to the ground and, together, they produce a ring of circular patches surrounding the sprinkler.

While the top view of this sprinkler is completely identical to that of the previous embodiment shown in FIG. 5, the differences become evident in FIGS. 7 and 8. The rim 12 is flat rather than flaring, and the bottom surfaces 16 of the slots 14, rather than being contained in a common, radial plane, begin to slope inwards and downwards from a point close to their outside ends.

While in the previous embodiments most of the liquid left the sprinkler by flowing across the curved rim, here flow takes place mainly through the curved slots. What was said previously about the curves defining the shape of the rim 12, applies also here to the curving bottom surface 16 of the tangential slots 14.

All of the sprinklers mentioned so far are mounted near the ground by any of the conventional means, such as stakes, to which they may be attached in an as such known manner, or which may be an integral part of the sprinkler body.

FIG. 9 illustrates an embodiment in which, to obtain the above-mentioned effects, the distance between the transition portion 26 and the bottom surface 6 of the lower chamber 30 may be varied. The sprinkler consists of the head 32 which carries the slots 14, and a bore through which constitutes the upper chamber 28, while its lower end face forms the portion 26. This head is fixedly attached, say, by a press fit, to the sleeve-like body 2, which is also provided with the tangential inlet tube 10. The bottom surface 6 is provided by the flat face of the plunger-like end portion of which otherwise serves as mounting stake 34 with a pointed tip 36. By using the sleeve-like body 2 to a greater or lesser degree over the stake 34, the above-mentioned distance can be varied. The stake 34 is either a fricition fit in the bore of the body 2, or else there can be provided detent or indexing means, on the upper end portion of the stake 34 may be threaded, with a corresponding female thread in the body 2. There may also be provided, on the shank of the stake, a scale (not shown) for reproducibility of the effects obtainable by changing the above distance.

Obviously, instead of the stake 34 serving as an adjustable bottom surface 6, it is also possible to use for this purpose a cylindrical, lug-like member adjustable in any of the ways already mentioned.

While the embodiments shown so far have a 360°-throw, it was found to be possible to obtain a throw extending over a limited angular sector, say, between 90° and 180°, by altering the geometry of the bottom surface 6, for instance by having an inclined bottom surface, or a roof-shaped one, a convex, concave, inwardly tapering bottom surface, etc.

A change of the spray pattern is also achieved by varying the geometry of the tangential inlet. One such variation would consist in continuing the straight portion of the tangential inlet 10 in the form of an involute inlet scroll substending up to about 180°. A similar effect is also had by varying the configuration of the output side (spacing of slots 14, shape of rim 12, etc.).

It should also be noted that while in the embodiments shown, the slots 14 of one and the same sprinkler are all of uniform depth, embodiments are envisaged in which this depth may vary.

It is also possible to combine, in one sprinkler, the features shown in FIGS. 4, 5, 6 and FIGS. 7, 8 and 9, by having the flat-bottomed slots alternate with the slanting-bottom slots, and the curved rim portions between the slots with the flat rim portions.

While in the embodiments shown in FIGS. 1 to 6 the above-mentioned radial plane, containing the bottom surfaces of the slots 14, intersects the vortex chamber wall 21 at, or close to,the level where the latter just begins to flate, an embodiment is also envisages in which this plane intersects the vortex chamber wall at an already flared portion thereof, thus the slots are out in a direction substantially tangential with respect to an imaginary circle constituting the intersection between the plane containing the bottom surfaces of at least some of the slots, and the flaring portion of the vortex chamber.

It will be evident to those skilled in the art that the invention is not limited to the detail of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A vortex sprinkler comprising:

a vortex chamber delimited in the downward direction by a bottom surface and in the upward direction by a rimmed opening leading to the atmosphere;

at least one liquid inlet leading substantially tangentially into said vortex chamber, a plurality of slots cut across the rim of said opening, wherein said slots are cut in a direction substantially tangential with respect to said vortex chamber, and wherein said slots are angularly spaced in such a way that adjacent slots intersect.

2. The vortex sprinkler as claimed in claim 1, wherein the bottom surfaces of at least some of said slots are substantially contained in a substantially radial plane and wherein, from a point close to the intersection of said plane with the wall surface of said vortex chamber, at least some portions of said wall surface begin to flare outwards towards the outer edge of said rim.

3. The vortex sprinkler as claimed in claim 1, wherein, from a point close to the outside end of said tangential slots, the bottom surfaces of at least some of said slots begin to slope inwards and downwards.

4. The vortex sprinkler as claimed in claim 1, further comprising a shoulder-like transition portion, whereby said vortex chamber is subdivided into an upper chamber, contiguous with said opening, and a lower chamber contiguous with said bottom msurface, the diameter of said upper chamber being smaller than that of said lower chamber.

5. The vortex sprinkler as claimed in claim 4, wherein said tangential liquid inlet leads into said lower chamber.

6. The vortex sprinkler as claimed in claim 4, wherein the distance between said shoulder-like transition portion and said bottom surface is variable.

7. The vortex sprinkler as claimed in claim 6, wherein said distance is varied by axial translation, inside said lower chamber, of a plunger-like body one of the flat end faces of which constitutes said bottom surface.

8. The vortex sprinkler as claimed in claim 7, wherein said plunger-like body also serves as mounting stake of said sprinkler, to which purpose one of the ends thereof is pointed.

9. A vortex sprinkler combining:

a vortex chamber delimited in the downward direction by a bottom surface and in the uwpard direction by a rimmed opening leading to the atmosphere;

at least one liquid inlet leading substantially tangentially into said vortex chamber, and a plurality of slots cut across the rim of said opening, wherein at least a portion of the wall of each slot flares upwardly and outwardly, and wherein said slots are cut in a direction substantially the tangential with respect to an imaginary circle constituting the intersection between the plane containing the bottom surfaces of at least some of the slots, and said flaring portion of said vortex chamber.

10. A vortex sprinkler for irrigation purposes comprising:

(a) a body having a bottom at one end and a rimmed opening at the other end for defining a vortex chamber;

(b) an inlet tube attached to the body defining an inlet that is tangential to said chamber;

(c) said rimmed opening having a plurality of slots extending tangentially with respect to said chamber, each slot having a longer and shorter wall; and (d) said slots being constructed and arranged such that the longer wall of one slots intersects the shorter wall of an adjacent slot.

11. A vortex sprinkler combining:

a vortex chamber delimited in the downward direction by a bottom surface and in the upward direction by a rimmed opening leading to the atmosphere;

at least one liquid inlet leading substantially tangentially into said vortex chamber, and a plurality of slots cut across the rim of said opening, wherein at least a portion of the wall of each slot flares upwardly and outwardly, wherein said slots are cut in a direction substantially tangential with respect to an imaginary circle constituting the intersection between the plane containing the bottom surfaces of at least some of said slots, and said flaring portion of said vortex chamber, and wherein said slots are angularly spaced in such a way that adjacent slots intersect.

* * * * *

UNITED STATES PATENT AND TRADEMARK OFFICE

CERTIFICATE OF CORRECTION

PATENT NO. : 4,717,076

DATED : January 5, 1988

INVENTOR(S) : Yosef NOTKIN

It is certified that error appears in the above-identified patent and that said Letters Patent is hereby corrected as shown below:

At column 1, line 1 of the printed patent, change "sprinklr" to ---sprinkler---.

At column 2, line 39, change "advantageously such" to ---advantageous in---.

At column 2, line 68, change "tangentially" to ---tangentiality---.

At column 3, line 54, delete ",".

At column 4, line 3, change "which" to ---what ---.

At column 4, line 9, change "on" to ---or---.

At column 4, line 44, change "to,the" to ---to, the---.

At column 4, line 45, change "flate" to --- flare---.

At column 4, line 45, change "envisages" to --- envisaged---.

At column 4, line 54, change "detail" to --- details---.

At column 5, line 27, change "msurface" to --- surface---.

UNITED STATES PATENT AND TRADEMARK OFFICE

CERTIFICATE OF CORRECTION

PATENT NO. : 4,717,076

DATED : January 5, 1988

INVENTOR(S) : Yosef Notkin

It is certified that error appears in the above-identified patent and that said Letters Patent is hereby corrected as shown below:

At column 6, line 2, change "uwpard" to --upward--.

Signed and Sealed this

Twenty-fifth Day of April, 1989

*Attest:*

*Attesting Officer*

DONALD J. QUIGG

*Commissioner of Patents and Trademarks*